United States Patent [19]

Hole

[11] 4,049,276

[45] Sept. 20, 1977

[54] BOARD GAME APPARATUS

[76] Inventor: Richard A. Hole, 3850 Abbotsford Road, Rockford, Ill. 61107

[21] Appl. No.: 727,244

[22] Filed: Sept. 27, 1976

[51] Int. Cl.[2] ..... A63F 3/04

[52] U.S. Cl. ..... 273/134 AC; 273/134 AD; 273/134 C; 273/134 D; 273/134 AT

[58] Field of Search ..... 273/134

[56] References Cited

FOREIGN PATENT DOCUMENTS 915,550 1/1963 United Kingdom ..... 273/134 AC

*Primary Examiner*—Delbert B. Lowe

*Attorney, Agent, or Firm*—Charles J. Speciale

[57] ABSTRACT

A game apparatus including a game board illustrating a map of the United States designating certain cities connected by color coded airplane flight routes, an equal number of checkpoints on each flight route identifying the location of each flight at all times, an alternate flight route being provided for each flight in the same color code, unequal numbers of checkpoints on the alternate flight routes; color coded miniature jet airplane markers; color coded board markers; a pair of dice; a plurality of randomly sortable "airmanship cards" denoting the airmanship of the pilot; a plurality of randomly sortable "decision cards" offering alternative decisions to the pilot during flight; and a plurality of randomly sortable "enroute cards" based on a variety of situations encountered by the pilot.

6 Claims, 4 Drawing Figures

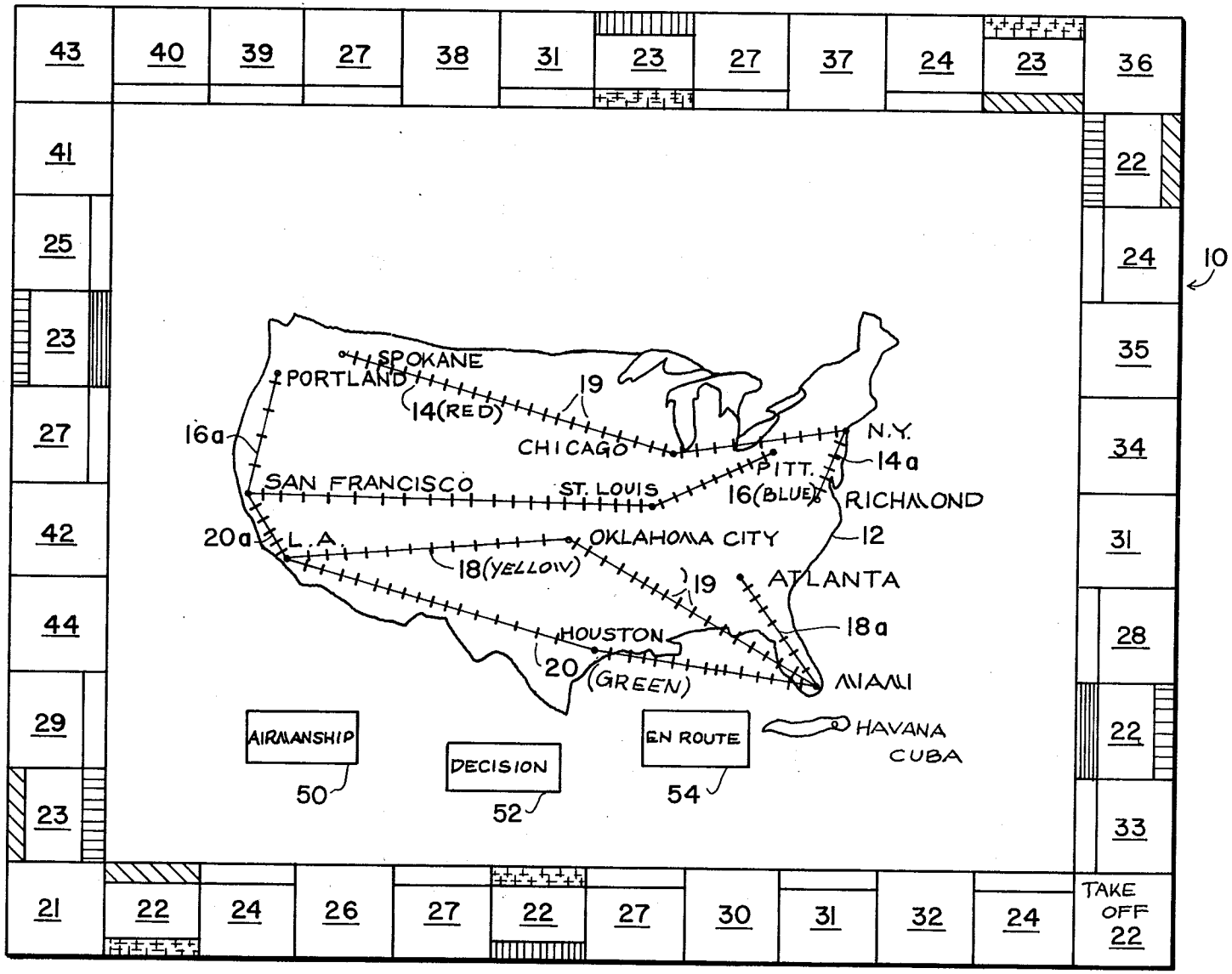
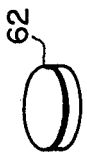
FIG. 4
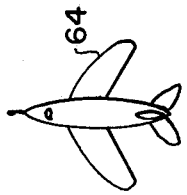
FIG. 3
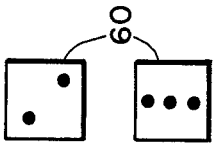
FIG. 2
FIG. 1

BOARD GAME APPARATUS

BACKGROUND OF THE INVENTION

1. Field of the Invention

This invention relates to educational and amusement devices or games and more particularly to a geographical air travel game played upon a game board.

2. Description of the Prior Art

Various games relating to airline travel and played upon a game board are known to the prior art. For example, U.S. Pat. No. 1,609,262 discloses an air travel game in which miniature airplanes are insertable by means of pins mounted thereon into a cork base designating a geographic location. Printed instructions are applicable to each location. A roll of the dice determines the distance to be moved. The first player to circle the glove and return to the starting point wins the game. No skill or discretion on the part of the players is involved, just mere chance.

U.S. Pat. No. 3,467,387 has as its object a predetermined total of financial possessions of visited locations. The game uses several decks of cards to accomplish its objective.

U.S. Pat. No. 3,726,527 is similar to the immediate above but more complicated in requiring business judgement and knowledge.

U.S. Pat. Nos. 3,638,946; 3,658,337; and 3,883,142 disclose other board game devices which are of interest in involving game boards and various modes of transportation moving about them, e.g., car, airplane, boat, even walking.

None of the foregoing, as will be seen, discloses the present inventive combination.

SUMMARY OF THE INVENTION

It is, therefore, among the principal objectives of this invention to provide a board game apparatus improved over the prior art both in skill and amusement as well as in educational value.

The objective of this invention game is twofold: (1) arrive at your destination first; and (2) score the most points. Both criteria must be achieved in order to be the winner. The game apparatus includes a game board illustrating a map of the United States designating certain cities connected by color coded airplane flight routes, an equal number of checkpoints on each flight route identifying the location of each flight at all tims, alternate flight routes being provided for each flight in the same color coding aforementioned, not necessarily the same number of checkpoints on each alternate flight leg; a chance number indicator such as a pair of dice; color coded miniature jet airplane markers; color coded board markers; a plurality of randomly sortable "Airmanship Cards," "Decision Cards," and "Enroute Cards."

This game is played with two types of markers; miniature jet airplane markers that move across the jet routes on the map and show the location of each flight at all times, and board markers that move around the border of the game board based on rolls of the dice. The board markers, together with Airmanship, Decision and Enroute Cards described below, determine the progress of each jetliner towards its destination. Each of the four jet routes, airplane markers and board markers are color coded for identification. Various blocks around the border of the game board are color-coded to the colors of the various flights. When a player's board marker lands on a block of the same color, the player advances his aircraft the number of checkpoints specified on that block.

Airmanship Cards describe various situations encountered by each player as "Captain" of his/her flight and are self-explanatory. Airmanship Cards are "points" type cards and do not affect the progress of the flight towards its destination.

Decision Cards offer alternative decisions to the "Captain" that affect both points and progress of the flight.

Enroute Cards can affect both progress of the flight and points scored (or lost) enroute to your destination and are based on a variety of situations encountered by the "Captain" (pilot).

Checkpoints are used by pilots to establish their position over the surface of the earth at all times. Pilots of modern day jetliners do not need to see the ground to know where they are. Modern jetliners utilize "electronic" checkpoints that register on instruments in the cockpit. For the purposes of this game, checkpoints are represented by the short lines drawn perpendicular to the route. The distances (checkpoints) from the originating airports to the intended destination airports are the same for all flights. However, the distances from the original destination airports to the alternate destination airports vary somewhat. Consequently, it may be advisable to select the flight with the shortest distance to its alternate airport in the event the flight should have to continue to its alternate airport.

BRIEF DESCRIPTION OF THE DRAWING

The invention will be hereinafter more fully described with reference to the accompanying drawing, in which:

FIG. 1 is a plan view of the playing board illustrating the map of the United States with flight routes and alternate routes shown, and indicating the various border marker positions;

FIG. 2 is a plan view of a pair of dice used to determine the length of a move for the player along the border positions;

FIG. 3 is a top plan view of a miniature jet airplane marker; and

FIG. 4 is a perspective view of a border marker.

DESCRIPTION OF THE PREFERRED EMBODIMENTS

Referring now to the figures of the drawing there is shown therein a game board 10 showing a map 12 of the United States (except in Hawaii and Alaska). The flight routes are designated as Spokane-Chicago-New York, color coded red and signified by the reference numeral 14; Pittsburgh-St. Louis-San Francisco, color coded blue and signified by the reference numeral 16; Los Angeles-Oklahoma City-Miami, color coded yellow and signified by the reference numeral 18; Miami-Houston-Los Angeles, color coded green and signified by the reference numeral 20. Each flight has the same number of checkpoints 19 (drawn perpendicular to the route) which in this instance are 30 in number (this can vary as can color codings). Each flight has a predetermined alternate destination in keeping with good safety precautions practiced by all major airlines. To wit, red flight's alternate is Richmond 14*a;* blue's is Portland 16*a;* yellow's is Atlanta 18*a;* and Green's is San Francisco 20*a.* As mentioned earlier, the numbers of checkpoints for the alternate flights are not necessarily the same.

Game board 10 has all four borders marked off in boxes numbering 40 in all, 12 each on the top and bottom borders, and 8 each on the side borders. Each box has a number designated therein, which number specifies specific instructions pertaining thereto. Table I immediately hereinbelow collates these box numbers with their specific instructions in the manner according to the invention.

TABLE I

21 Foul Weather Lose Next Turn
22 Advance 1 Check Point
23 Advance two Check Points
24 Airmanship Take 1 Card
25 Airmanship Take 2 Cards
26 Special Air Traffic Clearance Advance 2 Check Points
27 Decision Take 1 Card
28 Decision Take 2 Cards
29 Enroute Take 2 Cards
30 Exceptional Blind Flying Ability Advance 3 Check Points or Score 30 Points
31 Enroute Take 1 Card
32 Bomb Scare Lose Next Turn
33 Won Air Safety Award Score 25 Points
34 Roll 10 or Higher to Advance 3 Check Points
35 Excellent Technique Advance 2 Check Points or Score 20 Points
36 Saw Flying Saucer Take 1 Extra Turn
37 Off Course Lose 20 Points
38 Marvelous Navigation Advance 2 Check Points or Score 20 Points
39 Rough Air Slow Down Return 2 Check Points
40 Sky Jack Lose 10 Points Fly to Cuba Roll 9 or Higher to Resume Flight at Point of Sky Jack or Resume After 3 Rolls
41 Excellent Knowledge of Air Traffic Rules. Score 20 Points
42 Roll 8 or Higher Return 2 Check Points
43 Blue Skies Take One Extra Turn
44 Complimentary Letter from Airline President Score 30 Points.

Additionally, some of the numbered boxes are color coded as well for the reason indicated earlier. The boxes are color coded in random fashion, however, each color is represented four times.

Table I refers to the "Airmanship Cards," "Decision Cards" and "Enroute Cards." These are identified by the reference numerals 50, 52, and 54, respectively, and are illustrated only diagrammatically. In this specific embodiment there are about 25 of each but this number may vary.

Airmanship Cards 50 are printed on one face with messages such as the following:

1. Because Snoopy is your favorite pilot — score 10 points!
2. Because you discovered and reported a malfunctioning radio navigation device — score 15 points!
3. Because you bounced on a recent landing — lose 20 points!
4. Because stewardess spilled salad on passengers — lose 10 points!
5. Last month you made a mistake in your Pilot Log Book — lose 10 points! (Two cards are used.)
6. Because you blamed your last bad landing on your First Officer — lose 10 points!
7. Because you goofed on a recent flight and announced an incorrect landmark to your passengers — lose 20 points!
8. Because you had Chicken Pox and couldn't take your last flight physical on time — lose 5 points!
9. Because you overshot a recent landing and stuck the nosewheel in the mud — lose 20 points!
10. Because you became "owly" with your First Officer when he suggested that you brush up on Air Traffic Regulations — lose 10 points!
11. Operations complimented you on the beautiful writing in your Pilot Log Book — score 10 points! However, because you made a mistake — lose next turn!
12. Stewardess sits on your lap — score 10 points! However, because it is against regulations — lose your next turn!
13. Because you petted a small fuzzy poodle on a passenger's lap — score 10 points! However, because dogs are not permitted in the passenger section — lose next turn!
14. Because you divide the flying time with the First Officer — score 10 points!
15. Because of your ability to produce fuzzy teddy bears for small passengers during bumpy flights — score 30 points!
16. Superior rating on recent proficiency flight check — score 30 points!
17. Your passengers think you are the best pilot ever — score 20 points!
18. You were voted "Pilot of the Month" by the Stewardess' Association — score 10 points!
19. Congratulations! Promoted to Senior Captain — score 25 points!
20. Won duck lover's award for delaying a recent take off because of a mother duck and ducklings on runway — score 20 points!
21. Passenger on a recent flight wrote letter to airline complimenting you — score 20 points!
22. Passed flight physical with flying colors — score 10 points!
23. Because of exceptional skill in adjusting engine and flight controls for maximum efficiency — score 15 points!

Decision cards 52 are printed on one face with decisions such as these:

1. Score 10 points or take 1 Airmanship Card! (This card used 2 times.)
2. May score 15 points or take 1 Enroute card. (Used once.)
3. May advance 1 check point or score 5 times the throw of 1 die. (Used 2 times.)
4. Return the throw of 1 die in check points or lose 30 points. (Used once.)
5. Return 1 check point or lose 3 times the throw of 1 die in points. (Used once.)
6. May return 3 check points or lose 10 times the throw of one die in points. (Used 2 times.)
7. Keep to prevent future Sky Jack or score 20 points now! (Used 2 times.)
8. May take 2 Enroute cards or score 20 points. (Used once.)
9. May return 2 check points or lose 3 times the throw of both dice in points! (Used 2 times.)

10. May advance 1 check point or score double the throw of both dice in points. (Used once.)
11. May return 2 check points or lose 20 points! (Used once.)
12. May take 1 Enroute card or 1 Airmanship card. (Used 2 times.)
13. May advance 1 check point or score 15 points. (Used 2 times.)
14. May score 5 times the throw of 1 die in points or take 1 Enroute card! (Used 2 times.)
15. May advance in checkpoints the throw of 1 die or score 10 times the throw of 1 die in points! (Used 2 times.)

Enroute cards 54 are printed on one face with various situations encountered by the pilot.

1. Because of your excellent voice communications with ground stations — score 20 points!
2. Because your cockpit radar indicates a severe storm directly on your course, you wisely detour and explain the situation to your passengers — score 15 points!
3. Because you arrived over your last checkpoint exactly on time — score 20 points for excellent navigation!
4. Because of excellent preflight planning, you took advantage of favorable tailwinds at your cruising altitude — advance 2 checkpoints!
5. Because you pointed out beautiful cloud formations to your passengers — score 10 points!
6. Because you arrived over your last checkpoint exactly on time — score 20 points for excellent navigation!
7. Because you flew well around a high flying flock of geese — score 10 points!
8. Because you keep your passengers advised concerning the progress of the flight — score 10 points!
9. Because of excellent pre-flight planning, you took advantage of favorable tailwinds at your cruising altitude — advance 2 checkpoints!
10. Because of exceptional skill in adjusting throttles and trim settings for maximum speed — advance 2 checkpoints!
11. Because your cockpit radar indicates a severe storm directly on your course, you wisely detour and explain the situation to your passengers — score 15 points!
12. Favorable tailwinds at your cruising altitude — advance 2 checkpoints!
13. Alternate Airport! Because the weather at your destination airport is below your landing minimum requirements — continue to your alternate airport!
14. Sky-Jack! Fly directly to Cuba. On next turn, roll 10 or higher to resume flight at point of Sky-Jack. May resume flight after 3 attempts but lose 20 points!
15. Encounter "Jet Stream" headwinds — roll (1) die and return the member of checkpoints thrown.
16. A ground station along your route reports that you were 5 miles off-course at your last check point — lose 30 points!
17. Encounter "Jet Stream" headwinds — roll 1 die and return the number of checkpoints thrown!
18. Encounter strong headwinds — return 1 checkpoints!
19. A ground station reports that you were 3 miles off-course at your last checkpoint — lose 20 points!
20. Sky-Jack! Fly directly to Cuba. On next turn roll 10 or higher to resume flight at point of Sky-Jack. May resume flight after 3 attempts but lose 20 points!
21. Because you got wise with an air traffic controller on the radio — lose 15 points!
22. You are entering a high density air traffic area and must slow down for safety — return 1 checkpoint. However, score 20 points for proper procedure.
23. Because you took proper evasive action because of an unidentified flying object — score 15 points!
24. Because you keep your passengers informed concerning the progress of the flight — score 10 points!
25. Alternate Airport! Because the weather at your destination airport is below your landing minimum requirements — continue to your alternate airport!

RULES OF THE GAME

1. Two, three or four players may play.

2. Starting with the player at the South (Texas) side of the board, each player in turn (clockwise) rolls the dice 60. The player with the highest dice roll wins his/her choice of flights; second highest roll wins second choice, etc. In case of ties, those who tied roll again until the tie is broken.

3. Each player places his color-coded "board marker," a circular disc 62, on the TAKE OFF 22 block on the game board 10.

4. Each player places his color-coded aircraft 64 at the airport where his flight originates, e.g., Flight Red originates at Spokane; Flight Blue at Pittsburgh, etc.

5. Again, each player, in turn (clockwise), starting at the South (Texas) side of the board rolls both dice to determine who starts the game. The player with the highest dice roll starts the game (attempts to take off) and each player follows in clockwise order.

6. Seven or higher is required to take off. If the first player fails to roll 7 or higher, play moves to the next player in clockwise order. If he rolls 7 or higher he moves his aircraft to the first checkpoint (the short line drawn perpendicular to the route) and passes the dice to the next player.

7. After reaching his first checkpoint, each player, in turn, rolls both dice. He then moves his board marker around the board (counterclockwise) the number of blocks thrown on the dice and follows the instructions shown on the block on which his marker lands, i.e., the legend of Table I.

8. Each time a player's board marker travels completely around the game board and passes the TAKE OFF block, the player moves his aircraft one checkpoint towards his destination.

9. The moment any player arrives at his/her destination or Alternate Airport and has the most points, that player wins the game!

SPECIAL SITUATIONS

A. When an aircraft reaches its destination or Alternate Airport, whichever is the case, it cannot be Sky-Jacked, or otherwise be forced to return in checkpoints. In other words, the only way an aircraft that has arrived at its destination can be affected is by points, either plus or minus!

B. If an aircraft arrives at its destination or Alternate Airport, but the player does not have the greatest number of points, the player continues to play as before, i.e., he continues to move his board marker based on his dice rolls and scores or loses points accordingly. The instant such a player scores more points than any other player, he wins the game! This is an unusual situation but can occur.

C. If a player receives a card requiring him to lose points, he can only lose points if he has points to lose, i.e., negative points are not utilized.

D. If a player arrives at his destination and receives a card involving both points and checkpoints, or lands on a block involving both, only the instructions concerning points shall be followed.

While this game has been illustrated with a map of the United States, it is to be understood that the world map could be used, or continents, or outer space, etc.

What is claimed is:

1. A game for at least two players comprising in combination:

a. a game board displaying a geographical area with a plurality of locations connected by color coded airplane flight routes, an equal number of checkpoints being provided on each flight route, a similarly color coded alternate flight route being additionally provided for each said flight route, checkpoints in turn being provided for each alternate flight route;

b. a strip provided on said game board along its border edges, said strip being divided into a plurality of individual units, a number inscribed in each unit, said number corresponding to a predetermined set of instructions as set forth in a legendary table therefor, a minority of said units being randomly color coded consistent with the color coding of said airplane flight routes, each color being represented equally;

c. a chance number indicator means;

d. at least two color coded miniature aircraft, said aircraft being movable between checkpoints from point of departure to point of destination along said airplane flight routes and alternate flight routes similarly color coded;

e. at least two color coded board markers, said markers being movable from one individual unit to another provided on said strip, pursuant to the number indicated by said chance number indicator means, said number inscribed in said individual unit providing the basis for the gain or loss of score points or the movement of said aircraft between checkpoints in accordance with the instructions set forth in said legendary table; and f. a first set of a plurality of cards designated as Airmanship Cards and relating solely to the gain or loss of score points; a second set of a plurality of cards designated as Decision Cards and relating to the gain or loss of score points or the movement of said aircraft between checkpoints; a third set of a plurality of cards designated as Enroute Cards and relating to the gain or loss of score points or the movement of said aircraft between checkpoints, said first, second, and third set of cards being selectable in accordance with the instructions set forth in said legendary table.

2. A game according to claim 1 wherein from two to four color coded miniature aircraft and from two to four board markers are provided enabling from two to four players to play the game.

3. A game according to claim 1 wherein said chance indicator means comprise a pair of dice and said board markers comprise circular discs.

4. A game according to claim 1 wherein said game board has parallel opposing top and bottom border edges and parallel opposing side border edges, said individual units totaling 40 in number, 12 each on said top and bottom border edges and 8 each on said side border edges.

5. A game according to claim 4 wherein two of said individual units are color coded in each border edge.

6. A game according to claim 1 wherein the objective of the game is for the winning player to arrive at the point of destination first and to score the most points.

* * * * *